US006670775B2

(12) United States Patent
Makino

(10) Patent No.: US 6,670,775 B2
(45) Date of Patent: Dec. 30, 2003

(54) PLASMA DISPLAY PANEL AND DRIVING METHOD THEREOF

(75) Inventor: Mitsuyoshi Makino, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/152,625

(22) Filed: May 23, 2002

(65) Prior Publication Data

US 2002/0175633 A1 Nov. 28, 2002

(30) Foreign Application Priority Data

May 24, 2001 (JP) ..... 2001-155860

(51) Int. Cl.[7] ..... G09G 3/10
(52) U.S. Cl. ..... 315/169.4; 315/169.3
(58) Field of Search ..... 315/169.1, 169.2, 315/169.3, 169.4

(56) References Cited

U.S. PATENT DOCUMENTS 5,331,252 A 7/1994 Kim ..... 315/169.4

FOREIGN PATENT DOCUMENTS

| | | | |
|---|---|---|---|
| EP | 1 003 149 A1 | 5/2000 | ..... G09G/3/28 |
| FR | 2 785 131 | 10/1999 | ..... H04N/5/335 |
| JP | 4-241383 | 8/1992 | ..... G09G/3/28 |
| JP | 5-250995 | 9/1993 | ..... H01J/17/49 |
| JP | 2503860 | 4/1996 | ..... G09G/3/28 |
| JP | 10-149133 | 6/1998 | ..... G09G/3/28 |
| JP | 2962039 | 8/1999 | ..... H01J/11/02 |
| JP | 2001-166734 | 6/2001 | ..... G09G/3/20 |

OTHER PUBLICATIONS

European Search Report dated Jul. 30, 2002.

*Primary Examiner*—Hoang V. Nguyen
(74) *Attorney, Agent, or Firm*—McGinn & Gibb, PLLC

(57) ABSTRACT

A PDP driving method, in which a stable writing discharge can be realized by using a scanning pulse whose width is narrow without changing a structure of the panel and an image having high light emitting luminance can be realized in the large number of scanning lines, is provided. When a scanning pulse is applied to scanning electrodes, a writing discharge is generated at all of display cells. Electric charge particles generated by the writing discharge at the display cells are supplied to display cells on the next scanning line by diffusion. The writing discharge is stably generated in high speed at the next scanning line when a scanning pulse is applied to the next scanning line by receiving the electric charge particles, consequently, the width of the scanning pulse can be made to be narrow. In order that the writing discharge is generated at display cells, which do not shift to a sustaining discharge, a sub scanning pulse being negative polarity is applied to common electrodes.

27 Claims, 11 Drawing Sheets

PLASMA DISPLAY PANEL AND DRIVING METHOD THEREOF

BACKGROUND OF THE INVENTION

The present invention relates to a plasma display panel (PDP) and a driving method of the PDP, in particular, which is operated by an alternating current (AC).

DESCRIPTION OF THE RELATED ART

A PDP, a liquid crystal display (LCD), and an electroluminescence display (ELD) are used as a flat display panel. The PDP has been used for a work station and a wall television set, as a display whose screen size can be made to be large. Recently, a PDP whose screen size is large, for example, a 40 inch-type or a 50 inch-type PDP has been realized. However, it is very difficult that a cathode ray tube (CRT) technology realizes this size of screen.

It is expected that the CRT display will be replaced by the PDP in the future, however, its cost is higher and also its power consumption is larger than those of the CRT display.

The PDP provides plural display cells arrayed in a matrix state. There are two light emitting systems at the PDP, that is, one is a direct current driving type (DC type) and the other is an alternating current driving type (AC type). At the DC type, electrodes are exposed in a discharge space filled with a discharge gas, and DC voltages are applied to the electrodes. At the AC type, the electrodes are covered with a dielectric layer and are not directly exposed in the discharge gas, and AC voltages are applied to the electrodes. Further, the AC type is classified into two types, that is, one type is a memory utilizing type that utilizes a memory function of the dielectric layer which stores electric charges, and the other type is a refreshing type that does not utilizes the memory function.

A conventional PDP provides a front substrate and a rear substrate facing the front substrate, and a designated interval exists between the front substrate and the rear substrate. Plural scanning electrodes and plural common electrodes are disposed in parallel in the row direction on the front substrate. Plural data electrodes are disposed in the column direction on the rear substrate.

The display cells (pixels), which are formed at points where the data electrodes cross the scanning electrodes and the common electrodes, emit light by making discharges generate by that a designated voltage is applied to each of the electrodes under designated conditions. The scanning electrodes and the common electrodes are covered with a first dielectric layer on whose surface a protection layer is formed, and the data electrodes are covered with a second dielectric layer on whose surface a designated fluorescent material is coated. With this structure, an image is displayed on the PDP.

FIG. 1 is a timing chart of driving voltage waveforms in one sub field (SF) at a driving method of a conventional memory utilizing type AC-PDP. As shown in FIG. 1, the 1 SF consists of a priming discharge period, a scanning period, and a sustaining period. At the priming discharge period, erasing pulses 21, priming discharge pulses 22, and priming discharge erasing pulses 23 are applied. At the scanning period, scanning pulses 24, and data pulses 27 are applied. And at the sustaining period, sustaining pulses 25 and 26 are applied.

In FIG. 1, the conventional memory utilizing type AC-PDP provides "m" scanning electrodes $S_i$(i=1, 2, . . . , m), "m" common electrodes $C_i$(i=1, 2, . . . , m), and "n" data electrodes $D_j$(j=1, 2, . . . , n), and each of the "m" scanning electrodes $S_i$ becomes a pair with each of the "m" common electrodes $C_i$. And each of the display cells is formed at a point where each of the data electrodes $D_j$ crosses each of the scanning electrodes $S_i$ and each of the common electrodes $C_i$.

First, at the priming discharge period, the erasing pulses 21 are applied to all of the scanning electrodes 12, and discharging is generated at display cells in discharge ON state, which have emitted light during the previous sustaining period, and all of the display cells are made to be an erasing state (discharge OFF state). This operation by the erasing pulses 21 is called as sustaining discharge erasing operation. In this, the erasing signifies that wall charges are decreased or made to be zero. The wall charges are explained in detail later.

Next, the priming discharge pulses 22 are applied to all of the common electrodes 13, and discharging is generated at all of the display cells by compulsion. And the priming discharge erasing pulses 23 are applied to all of the scanning electrodes 12, and all of the display cells are made to be an erasing state. In this, discharging operation by the priming discharge pulses 22 is called as priming discharge operation, and discharging operation by the priming discharge erasing pulses 23 is called as priming discharge erasing operation. These priming discharge operation and priming discharge erasing operation make the occurrence of the following writing discharge easy.

After the priming discharge erasing operation, in the scanning period, a scanning pulse 24 is applied to the scanning electrodes $S_1$ to $S_m$ in sequence by shifting the applying timing of the scanning pulse 24. And the data pulses 27 corresponding to display information are applied to the data electrodes $D_1$ to $D_n$ respectively, by matching with the timing applying the scanning pulse 24. The oblique line attached to the data pulses 27 shows that the presence/absence of data pulses 27 is determined in accordance with presence/absence of the display information data. When the scanning pulse 24 was applied, discharging is generated only at display cells corresponding to the data electrodes 19, to which the data pulses 27 were applied. This discharge is called as the writing discharge, because the display information is written in the display cells when the discharge is generated.

At the display cell where the writing discharge was generated, a positive electric charge called a wall charge is stored in the dielectric layer on the scanning electrode 12, and a negative wall charge is stored in the dielectric layer on the data electrode 19.

In the sustaining period, the first discharge is generated at the display cell, by adding the first sustaining pulse 25 being negative polarity applied to the common electrode 13 to the positive wall charge in the dielectric layer on the scanning electrode 12. When the first discharge was generated, a positive wall charge is stored in the dielectric layer on the common electrode 13, and a negative wall charge is stored in the dielectric layer on the scanning electrode 12. And the second discharge is generated, by adding the second sustaining pulse 26 applied to the scanning electrode 12 to the potential difference between positive and negative wall charges. As mentioned above, the discharge is sustained by adding the (n+1)th sustaining pulse to the potential difference of the wall charges formed by "n"th discharge (n is an integer), therefore, this discharge is called as a sustaining discharge. The light emitting luminance is controlled by the number of continuing times of the sustaining discharges.

The sustaining pulse 25 to be applied to the common electrode 13 and the sustaining pulse 26 to be applied to the scanning electrode 12 are adjusted to be low voltages so that the discharge is not generated by only applying the sustaining pulses 25 and 26. With this, at a display cell, in which a writing discharge was not generated, electric potential by wall charges does not exist before the first sustaining pulse 25 is applied. Therefore, even when the first sustaining pulse 25 is applied, the first sustaining discharge is not generated at the display cell, and the sustaining discharge is not generated after this.

FIG. 2 is a timing chart of driving voltage waveforms in one SF at a conventional AC-PDP described in Japanese Patent No. 2503860. At the driving voltage waveforms shown in FIG. 2, a sub scanning pulse 28 being negative polarity is applied to all of the common electrodes 13 in the scanning period. Driving pulses in the priming discharge period and the sustaining period are the same as those in FIG. 1, therefore, the same explanation is omitted.

At the writing discharge in a conventional AC-PDP, by applying the scanning pulses 24 to the scanning electrodes 12 and also applying the data pulses 27 to the data electrodes 19, display cells are selected and discharges are generated at the selected display cells. However, in order to generate the writing discharge surely, when the voltage of the scanning pulse 24 is made to be high, at a part of the display cells, to which only the scanning pulses 24 were applied, there was a case that an error discharge was generated between the scanning electrode 12 and the common electrode 13. A part of the display cells, discharged erroneously, was shifted to the sustaining discharge, and light was emitted from a display cell, which was not to be selected normally.

In order to solve this problem, at the Japanese Patent No. 2503860, the sub scanning pulse 28 being negative polarity is applied to all of the common electrodes 13 in the scanning period. By applying the sub scanning pulse 28 being negative polarity, the potential difference between the scanning electrode 12 and the common electrode 13 in the scanning period is made to be small. With this, the voltage value of the scanning pulse 24 can be made to be a high value that is necessary for the writing discharge, without the error discharge.

And also, in the Japanese Patent No. 2503860, it has been described that a sub scanning pulse being positive polarity (not shown) is applied to all of the common electrodes 13 in the scanning period. At the writing discharge, a discharge generating selectively between the scanning electrode 12 and the data electrode 19 (facing discharge) is made to be a trigger, and right after this, a discharge between the scanning electrode 12 and the common electrode 13 (surface discharge) is induced. With this, shifting to the sustaining discharge after the scanning period is made to be sure.

Further, in this Japanese Patent No. 2503860, various driving voltage waveforms in the priming discharge period, being different from those shown in FIGS. 1 and 2, have been proposed, at the cases that the structures of the display cells of the PDP are different and also the states after the priming discharge are different. And either the sub scanning pulse being negative polarity to prevent the error discharge or the sub scanning pulse being positive polarity to improve the shift to the sustaining discharge is adopted for being effective at the adopted structure and the state. In this patent, the sub scanning pulse 28 being negative polarity is used for preventing the error discharge.

FIG. 3 is a diagram showing a gray level displaying method at a conventional AC-PDP. As shown in FIG. 3, one field being a period in which one picture is displayed is divided into plural sub fields (four sub fields in FIG. 3). In this, the period, in which one picture is displayed, is a time that eyes of a human being does not recognizes a picture as a flicker, and is a period being less than 1/36 second, for example, about 1/60 second. In FIG. 3, each of sub fields SF1 to SF4 is composed of the priming discharge period, the scanning period, and the sustaining period, and the length of each sustaining period (the number of sustaining pulses) is different from one another. The luminance of display among the SFs is different from one another, and each of the sub fields can be turned on/off independently.

At the four sub fields shown in FIG. 3, in case that the luminance ratio is adjusted to 1:2:4:8 in the SF1 to SF4, when light is emitted from each of the SF1 to SF4 independently, 16 levels of the luminance can be displayed. That is, by the combination of the displaying on/off of the four SFs, the 16 levels of the luminance, from the luminance ratio 0 at the time when all of the SFs are not selected to the luminance ratio 15 at the time when all of the SFs are selected, can be displayed. Generally, when one field is divided into "n" sub fields, and the luminance ratio is set to be $1(=2^0):2(=2^1):\ .\ .\ .\ :2^{n-2}:2^{n-1}$, $2^n$ gray levels can be displayed.

At the conventional AC-PDP, in order to generate the writing discharge surely, it is necessary that the pulse width of the scanning pulse 24 is made to be large. Consequently, the scanning period, which is shown as the product of the width of the scanning pulse and the number of the scanning electrodes, becomes long, and a time, which can be used for the sustaining period in one SF, becomes short. Therefore, there is a problem that the light emitting luminance is lowered.

In order to solve this problem, in Japanese Patent No. 2962039, a technology, in which a time requiring for the writing discharge is shorten by improving a display cell structure, has been described. In this technology, a structure, in which the area of the data electrode being effective for the writing discharge is made to be large, was adopted. However, the manufacturing processes must be changed by the change of the display cell structure and there is a problem that the yielding ratio at manufacturing the PDP is decreased due to the complex display cell structure.

In Japanese Patent Application Laid-Open No. HEI 10-149133, a technology, in which the time interval from the priming discharge erasing to the writing discharge is shortened and the writing discharge is made to be high speed by that the priming discharge erasing pulse is inputted right before the writing discharge, has been described. However, at this technology, there is a problem that a special driver for inputting the priming discharge erasing pulse is required.

In Japanese Patent Application Laid-Open No. HEI 5-250995, a technology, in which auxiliary discharge cells are provided in addition to the display cells and the writing discharge is made to be high speed by generating discharge at the auxiliary discharge cells right before the writing discharge at the display cells, has been described. However, at this technology, there are problems that the PDP structure is made to be complex and its high resolution is not realized easily by providing the auxiliary discharge cells.

In Japanese Patent Application Laid-Open No. HEI 4-241383, a technology, in which a high potential pulse is added to a data pulse for making the writing discharge easy at the display cell at only the time when the writing discharge was not generated before one scanning pulse cycle at the adjacent display cell to the display cell, has been described. However, at this technology, there is a problem that a driving circuit for processing signals to output the high potential pulse corresponding to the state of the adjacent display cell to the display cell is newly required in addition to the data pulse corresponding to the on/off information at the display cell.

SUMMARY OF THE INVENTION

It is therefore an object of the present invention to provide a PDP and a driving method of the PDP, in which a special change for the structure of the current PDP is not required and only a slight change for the driving circuit of the current PDP is executed and the writing discharge can be executed stably by using scanning pulses whose width is small, and in which the light emitting luminance is made to be high by extending the sustaining period in one SF, and in which the high resolution can be obtained and the yielding ratio at the manufacturing is high.

According to a first aspect of the present invention, for achieving the object mentioned above, there is provided a PDP driving method. The PDP at the PDP driving method provides a first substrate having a plane shape and a second substrate having a plane shape which faces the first substrate, plural first row electrodes and plural second row electrodes arrayed in the row direction on the first substrate, plural column electrodes arrayed in the column direction on the second substrate, and plural display cells disposed at points where the plural column electrodes cross the plural first and second row electrodes. And the PDP driving method provides the steps of applying a scanning pulse to each of the plural first row electrodes by shifting the applying timing of the scanning pulse by a designated interval in a scanning period, writing display information in each of the plural display cells by applying a data pulse to each of the plural column electrodes by making the data pulse synchronize with the scanning pulse in the scanning period, making a sustaining discharge generate at only display cells selected corresponding to the display information by applying a sustaining pulse to the plural first and second row electrodes in a sustaining period, and making the selected display cells emit light. And the PDP driving method further provides the steps of applying a sub scanning pulse to the plural second row electrodes in the scanning period, making display cells, which do not generate the sustaining discharge later in the sustaining period, generate a writing discharge having first intensity by applying a scanning pulse to each of the plural first row electrodes in the scanning period, and making display cells, which generate the sustaining discharge later in the sustaining period, generate a writing discharge having second intensity by applying a scanning pulse to each of the plural first row electrodes and further by applying the data pulse to the plural column electrodes in the scanning period.

According to a second aspect of the present invention, in the first aspect, when the scanning pulse was applied to each of the plural first row electrodes, the writing discharge having first intensity is made to generate in the display cells, which do not generate the sustaining discharge later, by applying a data pulse having a first crest value, and the writing discharge having second intensity is made to generate in the display cells, which generate the sustaining discharge later, by applying a data pulse having a second crest value.

According to a third aspect of the present invention, in the second aspect, the first crest value is lower than the second crest value.

According to a fourth aspect of the present invention, in the third aspect, the data pulse having the first crest value is applied to all of the column electrodes in a bias state during almost all the scanning period, and a modulation voltage value is added to the column electrodes corresponding to display cells that generate the sustaining discharge later so that the voltage value applying to the column electrodes becomes the second crest value.

According to a fifth aspect of the present invention, in the first aspect, a scanning pulse cycle, which is the time interval $(t_{i+1}-t_i)$ in case that the timing when a scanning pulse is applied to the (i)th first row electrode is defined as $t_i$ and the timing when the scanning pulse is applied to the (i+1)th first row electrode is defined as $t_{i+1}$, is less than $2\mu$ seconds.

According to a sixth aspect of the present invention, in the first aspect, the writing discharge having first intensity is weaker than the writing discharge having second intensity.

According to a seventh aspect of the present invention, in the first aspect, the pulse width of the scanning pulse applying to the first electrode in the plural first row electrodes is wider than that applying to electrodes following the first electrode, and also the pulse width of the data pulse synchronizing with the scanning pulse applying to the first electrode in the plural first row electrode, is wider than the others, in the scanning period.

According to an eighth aspect of the present invention, in the first aspect, the crest value of the scanning pulse applying to the first electrode of the plural first row electrodes is larger than that applying to electrodes following the first electrode, in the scanning period.

According to a ninth aspect of the present invention, in the first aspect, a priming discharge and a priming discharge erasing are applied to the display cells at the first electrode in the plural first row electrodes to which the scanning pulse is applied, and the priming discharge and the priming discharge erasing are not applied to display cells following the display cells at the first electrode, in the scanning period.

According to a tenth aspect of the present invention, in the first aspect, the sub scanning pulse is negative polarity.

According to an eleventh aspect of the present invention, in the first aspect, a bias voltage being positive polarity is applied to the column electrodes in almost all the scanning period.

According to a twelfth aspect of the present invention, there is provided a PDP. The PDP provides a first substrate having a plane shape and a second substrate having a plane shape which faces the first substrate, plural first row electrodes and plural second row electrodes arrayed in the row direction on the first substrate, plural column electrodes arrayed in the column direction on the second substrate, and plural display cells disposed at points where the plural column electrodes cross the plural first and second row electrodes. And a scanning pulse is applied to each of the plural first row electrodes by shifting the applying timing of the scanning pulse by a designated interval in a scanning period, display information is written in each of the plural display cells by applying a data pulse to each of the plural column electrodes by making the data pulse synchronize with the scanning pulse in the scanning period, a sustaining discharge is made to generate at only display cells selected corresponding to the display information by applying a sustaining pulse to the plural first and second row electrodes in a sustaining period, and the selected display cells emit light. And a sub scanning pulse is applied to the plural second row electrodes in the scanning period, and display cells, which do not generate the sustaining discharge later in the sustaining period, are made to generate a writing discharge having first intensity by applying the scanning pulse, and display cells, which generate the sustaining discharge later in the sustaining period, are made to generate a writing discharge having second intensity by applying the scanning pulse and the data pulse.

According to a thirteenth aspect of the present invention, in the twelfth aspect, when the scanning pulse was applied to each of the plural first row electrodes, the writing discharge having first intensity is made to generate in the display cells, which do not generate the sustaining discharge later, by applying a data pulse having a first crest value, and the writing discharge having second intensity is made to generate in the display cells, which generate the sustaining discharge later, by applying a data pulse having a second crest value.

According to a fourteenth aspect of the present invention, in the thirteenth aspect, the first crest value is lower than the second crest value.

According to a fifteenth aspect of the present invention, in the twelfth aspect, the pulse width of the scanning pulse applying to the first electrode in the plural first row electrodes is wider than that applying to electrodes following the first electrode, and also the pulse width of the data pulse synchronizing with the scanning pulse applying to the first electrode in the plural first row electrodes, is wider than the others, in the scanning period.

According to a sixteenth aspect of the present invention, in the twelfth aspect a priming discharge and a priming discharge erasing are applied to the display cells at the first electrode in the plural first row electrodes to which the scanning pulse is applied, and the priming discharge and the priming discharge erasing are not applied to display cells following the display cells at the first electrode, in the scanning period, and the number of the plural first row electrodes and the number of the plural second row electrodes are increased, and the number of the display cells is increase.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
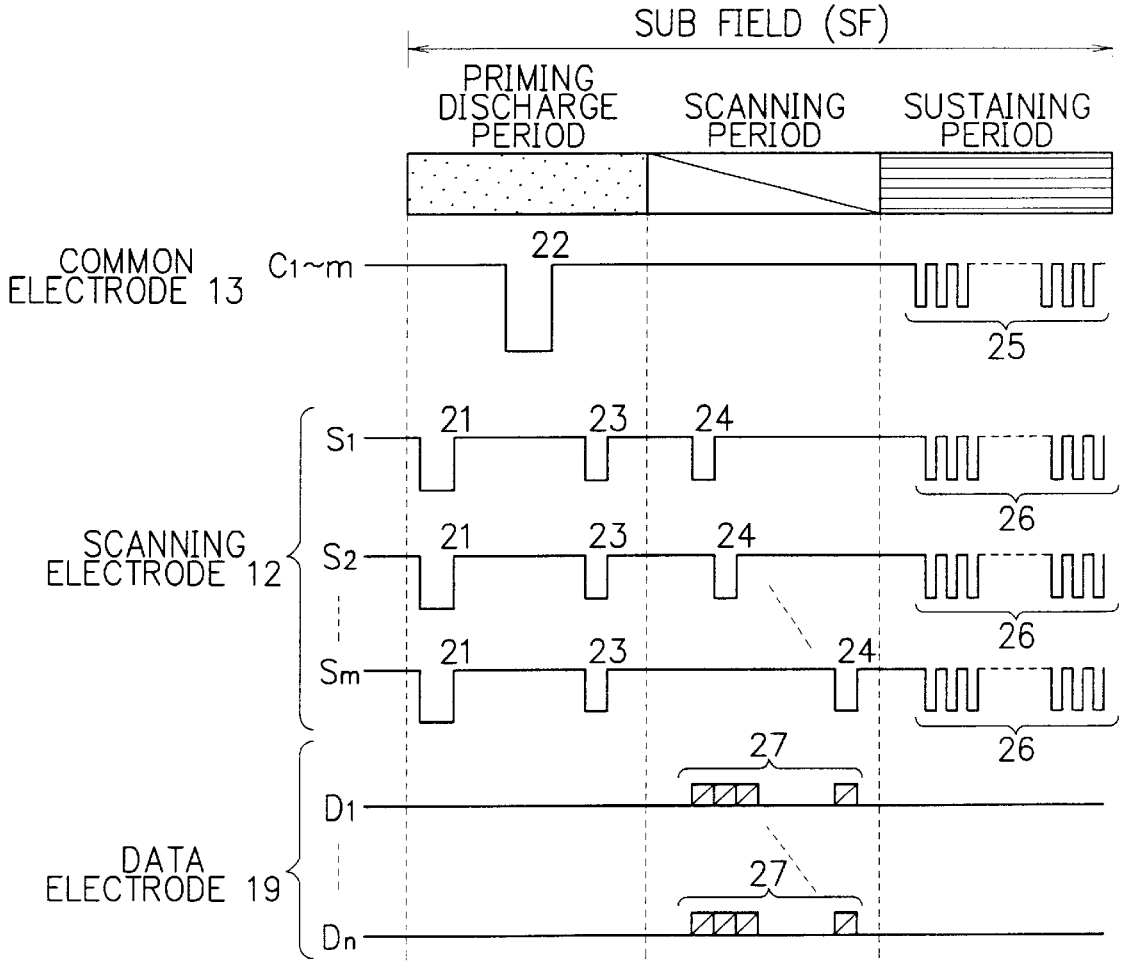
FIG. 1 PRIOR ART
FIG. 1 is a timing chart of driving voltage waveforms in one sub field (SF) at a driving method of a conventional memory utilizing type AC-PDP.

Referring now to the drawings, embodiments of the present invention are explained in detail. At the embodiments of the present invention, in case that each of functions at the embodiments of the present invention is almost equal to that at the conventional technologies, the same reference number at the conventional technologies is used at the embodiments of the present invention.

Figure 4:
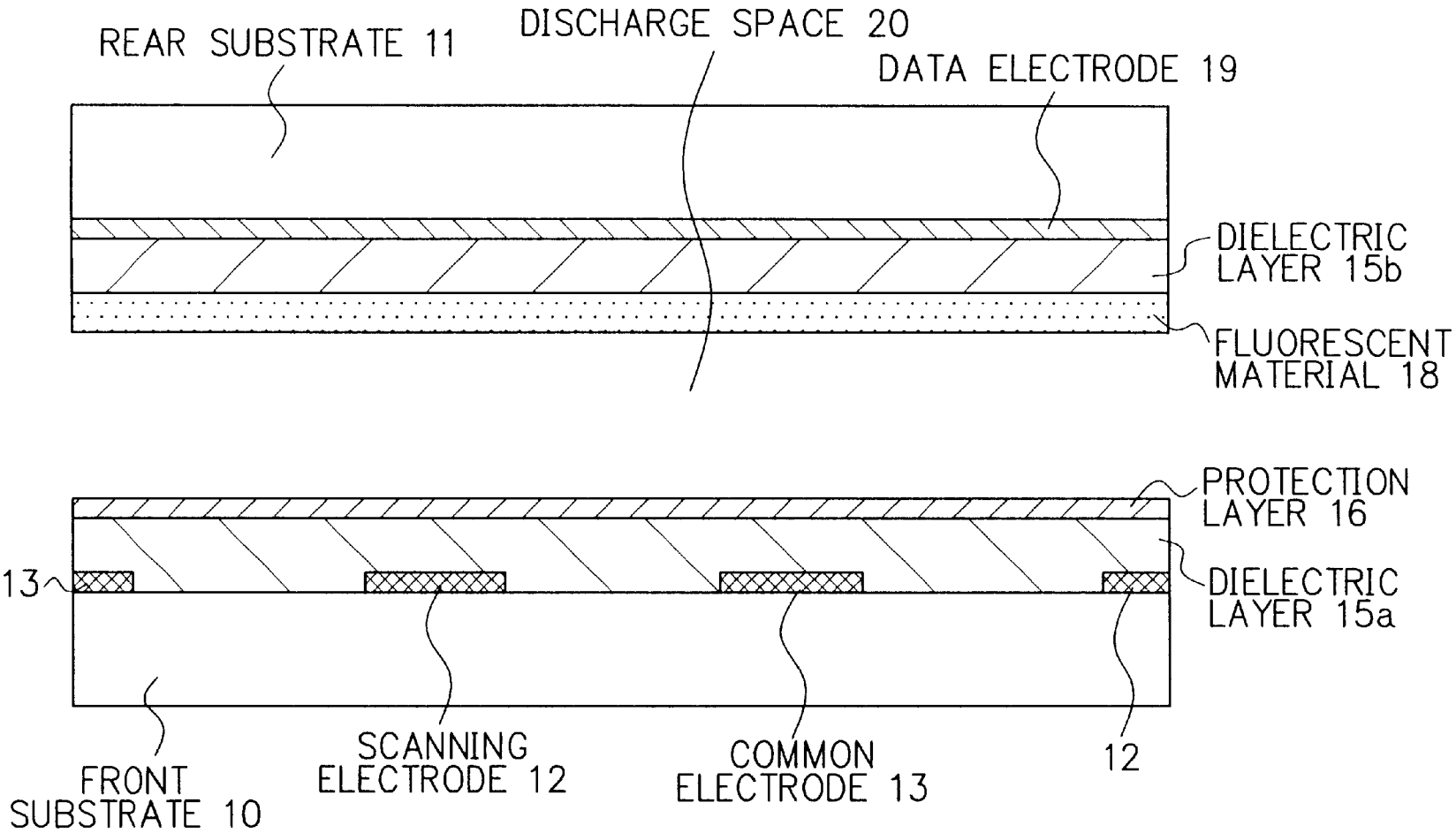
FIG. 4 is a sectional view showing a main part of an AC-PDP at embodiments of the present invention.

FIG. 4 is a sectional view showing a main part of an AC-PDP at the embodiments of the present invention. As shown in FIG. 4, the AC-PDP at the embodiments of the present invention has a structure in which a front substrate 10 made of a material such as glass and a rear substrate 11 made of a material such as glass facing the front substrate 10 were adhered by placing a discharge space 20 between them, and the discharge space 20 was sealed. On the front substrate 10, plural scanning electrodes 12 and plural common electrodes 13 are extended in the row direction (the perpendicular direction at the drawing) in a state that a designated interval exists between each of the scanning electrodes 12 and each of the common electrodes 13. In this, each of the scanning electrodes 12 and each of the common electrodes 13 becomes a pair. On the rear substrate 11, plural data electrodes 19 are extended in the column direction (perpendicular direction to the scanning electrodes 12 and the common electrodes 13). And display cells (not shown) are formed at points where the data electrodes 19 cross the scanning electrodes 12 and the common electrodes 13.

The scanning electrodes 12 and the common electrodes 13 are covered with a dielectric layer 15*a*, and a protection layer 16 made of a material such as MgO, which protects the dielectric layer 15*a* from discharge, is formed on the dielectric layer 15*a*. The data electrodes 19 are covered with a dielectric layer 15*b*, and a fluorescent material 18, which converts ultraviolet light generated by the discharge into visible rays, is coated on the dielectric layer 15*b*. The fluorescent material 18 of each of the light three primary colors (RGB) is coated separately on the point of each of display cells, and a color displaying structure of the AC-PDP can be realized.

The discharge space 20 is actually formed between the protection layer 16 on the front substrate 10 and the fluorescent material 18 on the rear substrate 11. And also walls (not shown) to separate each of the display cells are formed. In the discharge space 20, a discharge gas, which rare gases such as He, Ne, Ar, Kr, and Xe and a gas such as $N_2$, $O_2$, and $CO_2$ are mixed suitably, is filled and the discharge space 20 is sealed.

Figure 5:
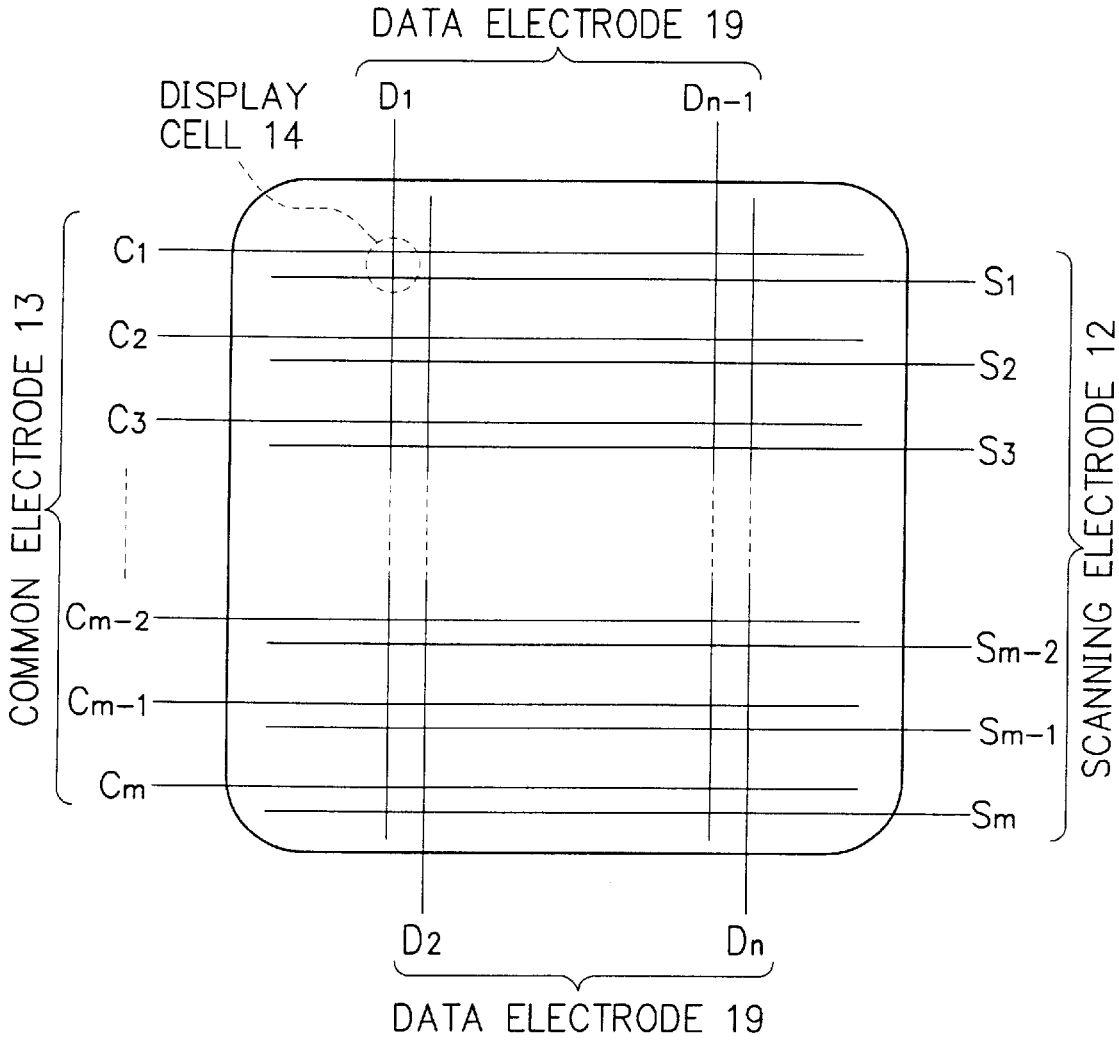
FIG. 5 is a plane view showing the main part of the AC-PDP at the embodiments of the present invention.

FIG. 5 is a plane view showing the main part of the AC-PDP at the embodiments of the present invention. As shown in FIG. 5, the AC-PDP at the embodiments of the present invention provides "m" scanning electrodes $S_i$(i=1, 2, . . . , m), and "m" common electrodes $C_i$(i=1, 2, . . . , m). And each of the "m" scanning electrodes $S_i$ and each of the "m" common electrodes $C_i$ become a pair, and a designated interval exists between the scanning electrode $S_i$ and the common electrodes $C_i$ of the pair. Further, "n" data electrodes Dj(j=1, 2, . . . , n) are provided in the column direction. And each of display cells 14 is formed at a point where each of the data electrodes $D_j$ crosses each of the scanning electrodes $S_i$ and each of the common electrodes $C_i$.

Figure 6:
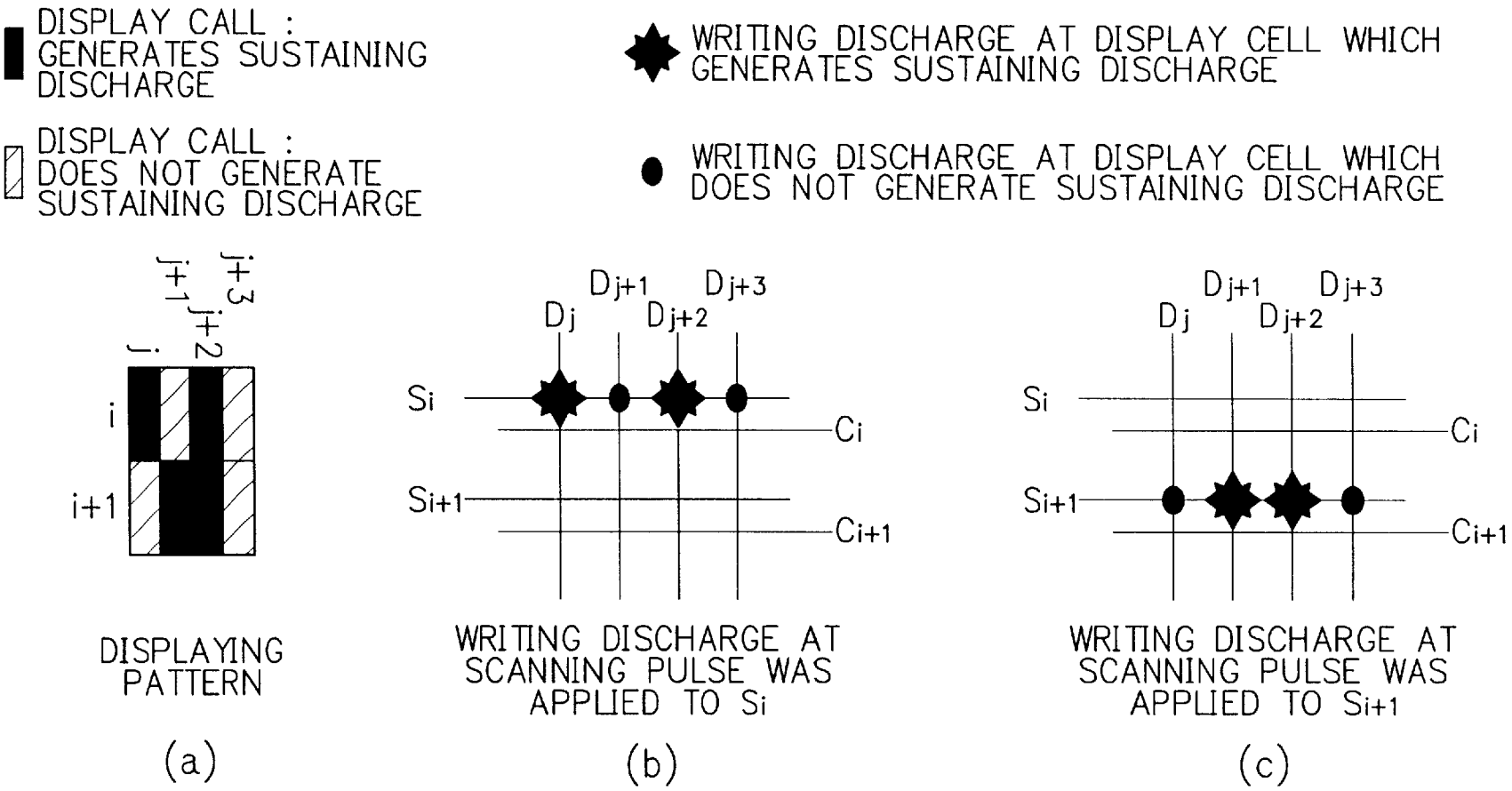
FIG. 6 is a diagram showing relations between a displaying pattern and writing discharges in the AC-PDP at the embodiments of the present invention.

FIG. 6 is a diagram showing relations between a displaying pattern and writing discharges in the AC-PDP at the embodiments of the present invention. In FIG. 6(*a*), a desiring pattern is shown in the display cells in two rows and four columns, that is, in the "i"th row to the "i+1"th row and the "j"th column to the "j+3"th column. In FIG. 6(*b*), when scanning pulses were applied to the scanning electrode $S_i$ at the "i"th row, the writing discharge is made to generate at not only display cells, which should execute the sustaining discharge at the "j"th column and the "j+2"th column, but also at display cells, which should not execute the sustaining discharge at the "j+1"th column and the "j+3"th column. And electric charge particles are supplied to display cells at the scanning electrode $S_{i+1}$ adjacent to the scanning electrode $S_i$.

In FIG. 6(*c*), when scanning pulses were applied to the scanning electrode $S_{i+1}$ at the "i+1"th row, the writing discharge is made to generate at not only display cells, which should execute the sustaining discharge at the "j+1"th column and the "j+2"th column, but also at display cells, which should not execute the sustaining discharge at the "j"th column and the "j+3"th column. And electric charge particles are supplied to display cells at the scanning electrode $S_{i+2}$ (not shown) adjacent to the scanning electrode $S_{i+1}$. As mentioned above, when the scanning pulse was applied to each of the scanning electrodes in sequence with a designated interval, the writing discharge is generated at all of the display cells, by applying a sub scanning pulse to each of common electrodes at the same time when the scanning pulse was applied to each of the scanning electrodes. This sub scanning pulse is explained later.

The first intensity of a writing discharge, which is generated at a display cell that does not shift to a sustaining discharge later, is weaker than the second intensity of a writing discharge, which is generated at a display cell that shifts to a sustaining discharge later. However, even the writing discharge having the first intensity generates a sufficiently large amount of electric charge particles in the discharge space. In this, the writing discharge intensity is the size of the light emitting output power or the size of discharge current.

At all of the display cells in an arbitrary scanning electrode 12, a writing discharge having the first or second intensity is generated at the time when a scanning pulse was applied, and space charges (electric charge particles) are generated at all of the display cells. The generated space charges spread on all of the display cells at the adjacent scanning electrode 12 to the arbitrary scanning electrode 12 by diffusion. Therefore, the display cells at all of the scanning electrodes 12 receive the electric charge particles from the display cells belonging to the right above scanning electrode 12, and the generation of the writing discharge becomes stable and sure. The discharge probability being an index showing the sureness of the generation of discharge increases extremely, compared with the case that the space charges are not supplied from the display cells at the right above scanning electrode 12.

Figure 2:
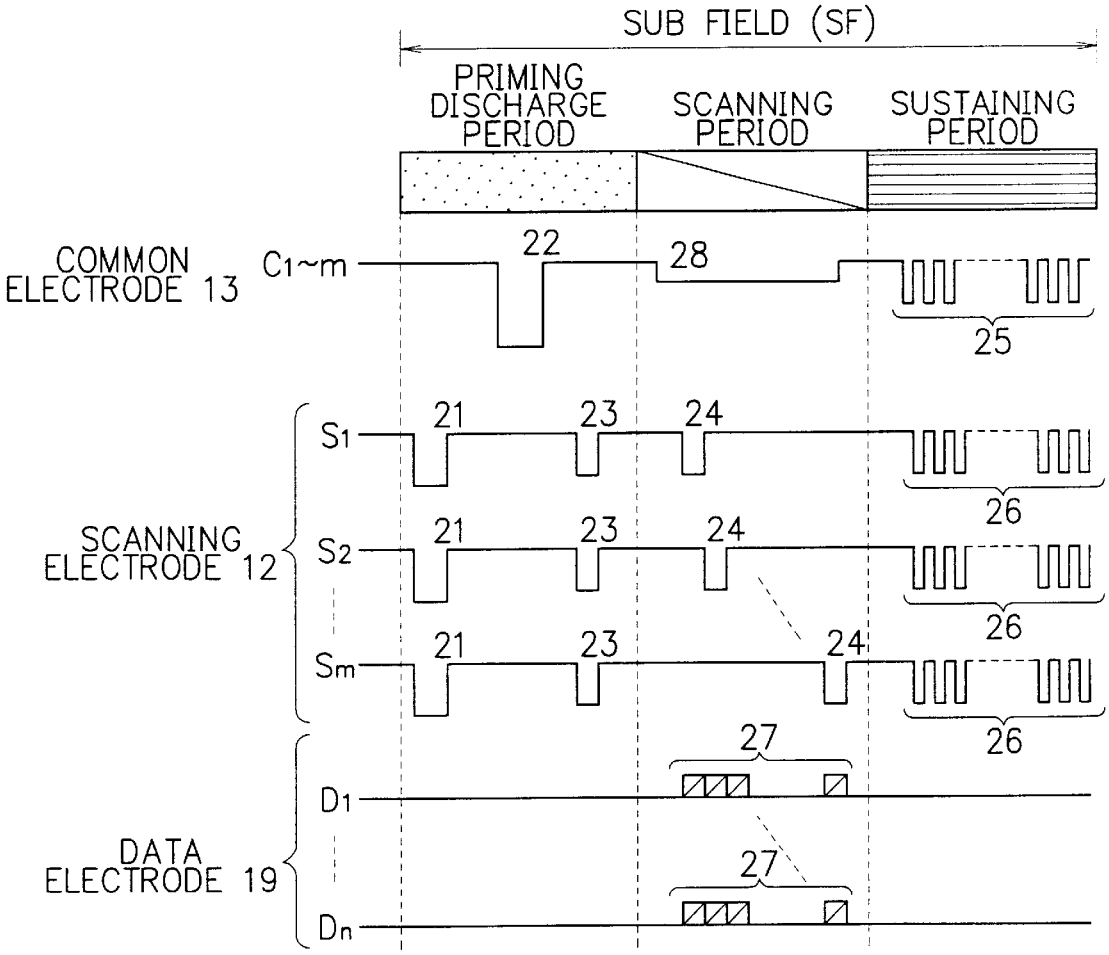
FIG. 2 PRIOR ART
FIG. 2 is a timing chart of driving voltage waveforms in one SF at a conventional AC-PDP described in Japanese Patent No. 2503860.
Figure 3:
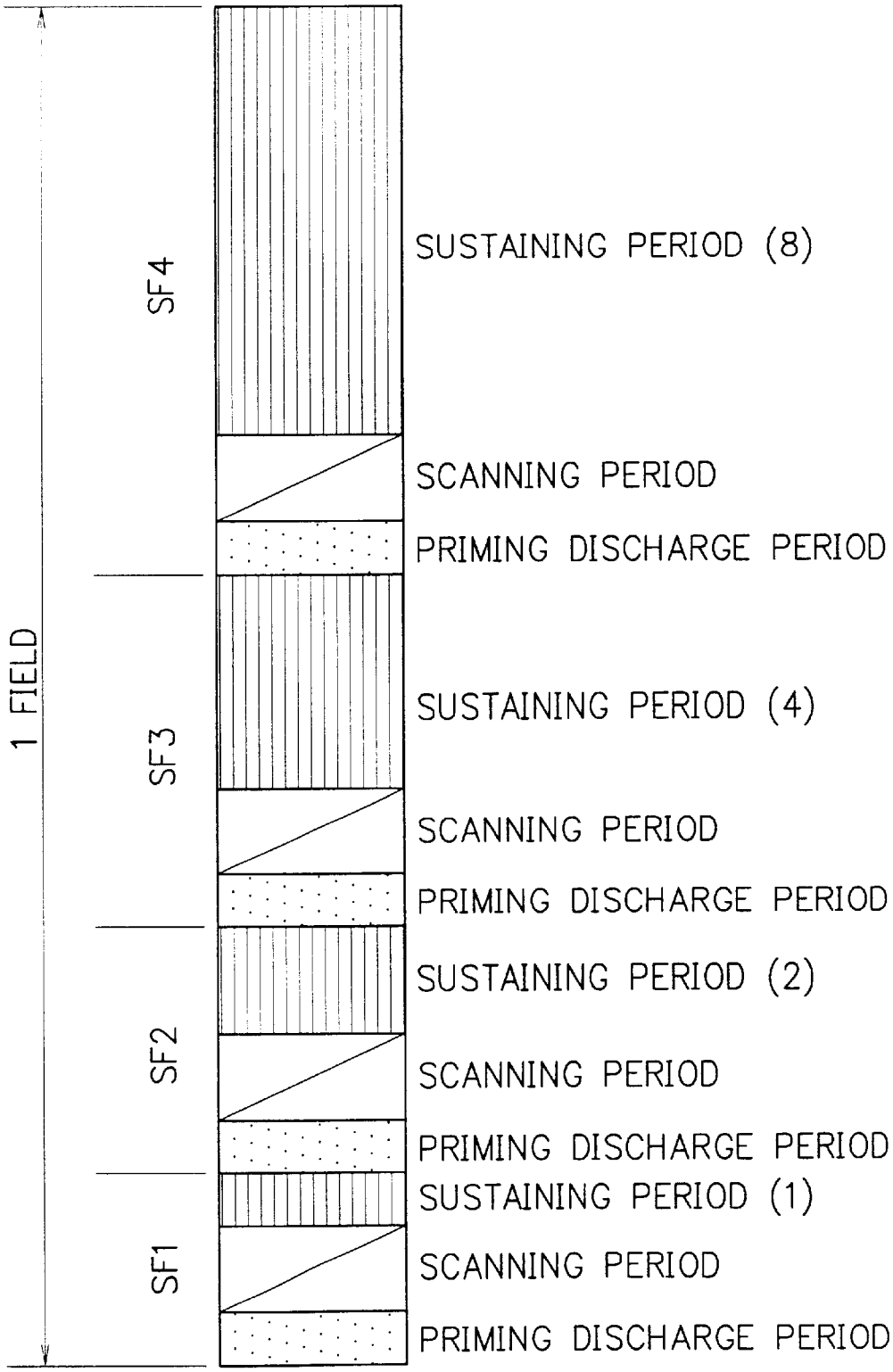
FIG. 3 PRIOR ART
FIG. 3 is a diagram showing a gray level displaying method at a conventional AC-PDP.

The writing discharge having high speed and being stable can be realized by supplying the electric charge particles from the adjacent display cells. Therefore, the width of the scanning pulse, which was made to be large to generate a sure discharge conventionally, can be made to be small at the present invention. Consequently, the scanning period shown in FIGS. 1 and 2 can be shortened and the sustaining period can be increased. Even a case that the number of scanning electrodes 12 is large, a displaying image, which has high resolution and high light emitting luminance and high quality, can be obtained. Further, it is not necessary to change the PDP structure specially.

Figure 7:
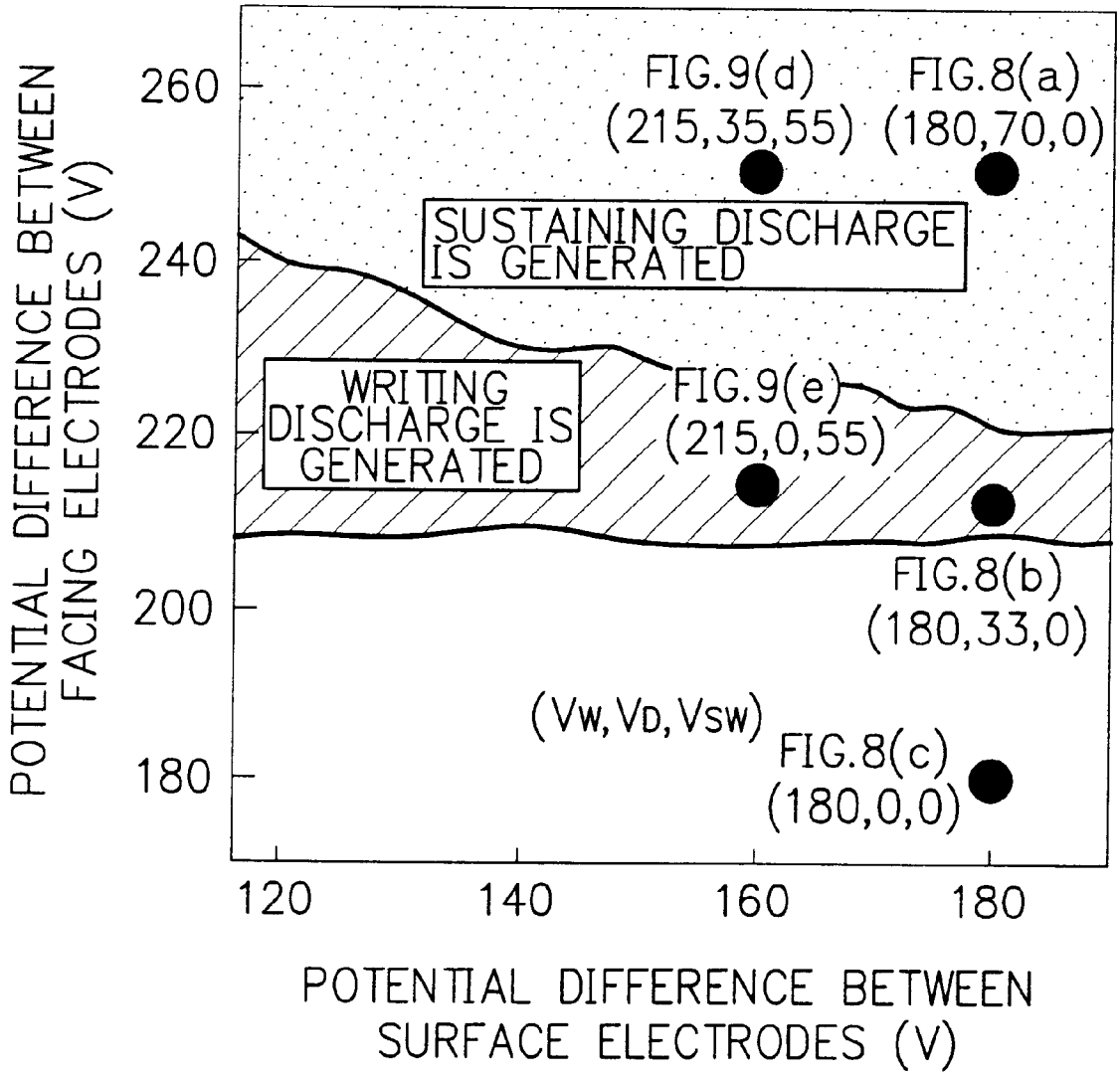
FIG. 7 is a diagram showing characteristics of states of the writing discharge in the relation between the potential difference between surface electrodes and the potential difference between facing electrodes in the AC-PDP at the embodiments of the present invention.

FIG. 7 is a diagram showing characteristics of states of the writing discharge in the relation between the potential difference between surface electrodes and the potential difference between facing electrodes in the AC-PDP at the embodiments of the present invention. In this, the potential difference between surface electrodes is the potential difference between the scanning electrode 12 and the common electrode 13, and the potential difference between facing electrodes is the potential difference between the scanning electrode 12 and the data electrode 19. As shown in FIG. 7, regardless of the potential difference between surface electrodes, when the potential difference between facing electrodes exceeds about 210V, the writing discharge is generated. In FIG. 7, $V_W$ shows the absolute voltage value of the scanning pulse, $V_D$ shows the absolute voltage value of the data pulse, and $V_{SW}$ shows the absolute value of pulse applying to the common electrode.

However, in case that the potential difference between facing electrodes exceeds only a few V above 210V, the writing discharge cannot be shifted to the sustaining discharge later. And when the potential difference between facing electrodes is made to be several V or dozens of V much more than that, the writing discharge is shifted to the sustaining discharge later. The potential difference between facing electrodes, which is required to shift to the sustaining discharge, depends on the potential difference between surface electrodes, and gradually decrease corresponding to that the potential difference between surface electrodes becomes large.

Referring to the drawings, the writing discharges at both the conventional technology and the present invention are explained.

Figure 8:
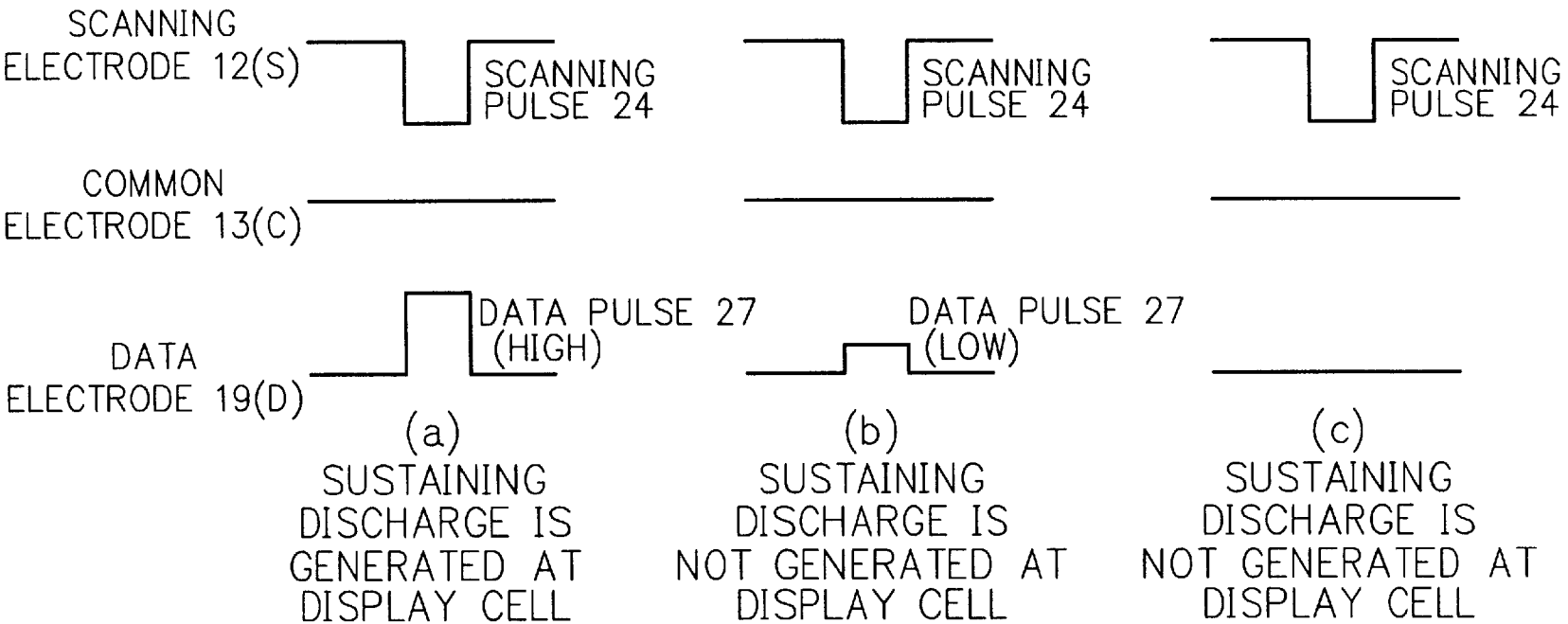
FIG. 8 PRIOR ART
FIG. 8 is a timing chart showing driving voltage waveforms at a conventional AC-PDP.

FIG. 8 is a timing chart showing driving voltage waveforms at a conventional AC-PDP. In FIG. 8(*a*), the sustaining discharge is generated at a display cell, because the potential difference between facing electrodes (scanning electrode 12 and data electrode 19) is high at the time when a scanning pulse 24 was applied. However, in FIGS. 8(*b*) and (*c*), the sustaining discharge is not generated at the display cell, because the potential difference between facing electrodes is low at the time when the scanning pulse 24 was applied. For example, as shown in FIG. 8(*c*), when a scanning pulse 24 being negative polarity of 180V is applied to the scanning electrode 12 and pulses are not applied to both the common electrode 13 and the data electrode 19, the potential difference between surface electrodes becomes 180V and the potential difference between facing electrodes also becomes 180V. Consequently, the writing discharge is not generated and also the sustaining discharge is not generated, as shown in FIG. 7.

And for example, as shown in FIG. 8(*a*), a scanning pulse 24 being negative polarity of 180V is applied to the scanning electrode 12 and a pulse is not applied to the common electrode 13 and a data pulse 27 being positive polarity of 70V is applied to the data electrode 19. In this case, the potential difference between surface electrodes becomes 180V and the potential difference between the facing electrodes becomes 250V. Consequently, the writing discharge is generated and also the sustaining discharge is generated, as shown in FIG. 7. The operation shown in FIGS. 8(*a*) and (*c*) is executed at the conventional AC-PDP.

And for example, as shown in FIG. 8(*b*), a scanning pulse 24 being negative polarity of 180V is applied to the scanning electrode 12 and a pulse is not applied to the common electrode 13 and a data pulse 27 being positive polarity of 33V is applied to the data electrode 19. In this case, the potential difference between surface electrodes becomes 180V and the potential difference between facing electrodes becomes 213V. Consequently, the writing discharge is generated but the sustaining discharge is not generated, as shown in FIG. 7.

In Japanese Patent Application Laid-Open No. 2001-166734, a following technology has been described. In this technology, a writing discharge, which is not shifted to a sustaining discharge mentioned above, is generated at a display cell that does not execute a sustaining light emission, and writing discharges at the other display cells are made to be high speed. However, as shown in FIG. 7, the range of the potential difference between facing electrodes, in which the writing discharge being not shifted to the sustaining discharge is generated, is narrow. The number of display cells, of which a large size PDP is composed, is more than one million, and the discharge characteristics of all the display cells are not entirely equal, and the voltages at the writing discharge and the sustaining discharge at the display cells are not completely equal. Therefore, if the voltage range, which each of the display cells can utilize, is not large enough, that is, the voltage range does not have a sufficient margin, the whole voltage range (set of each voltage range), in which all of the display cells can be controlled together, becomes very narrow and very difficult to use. Or in some cases, there is a possibility that the whole voltage range, in which all of the display cells can be controlled together, does not exist. The technology described in the Japanese Patent Application Laid-Open No. 2001-166734 is effective for the display cells, in which the dispersion of the discharge characteristics among the display cells is small. And also there is a possibility that this technology cannot be completely applied to a large size PDP, which has large number of display cells.

At the embodiments of the present invention, all of the display cells, of which a PDP (especially, a large size PDP) is composed, are controlled together by the same pulse composition. And in order to widen the range of the potential difference between facing electrodes, in which the writing discharge being not shifted to the sustaining discharge is generated, at each of the display cells, a sub scanning pulse being negative polarity is applied to the common electrode 13, and the potential difference between surface electrodes is decreased at the time when the scanning pulse 24 is applied.

Figure 9:
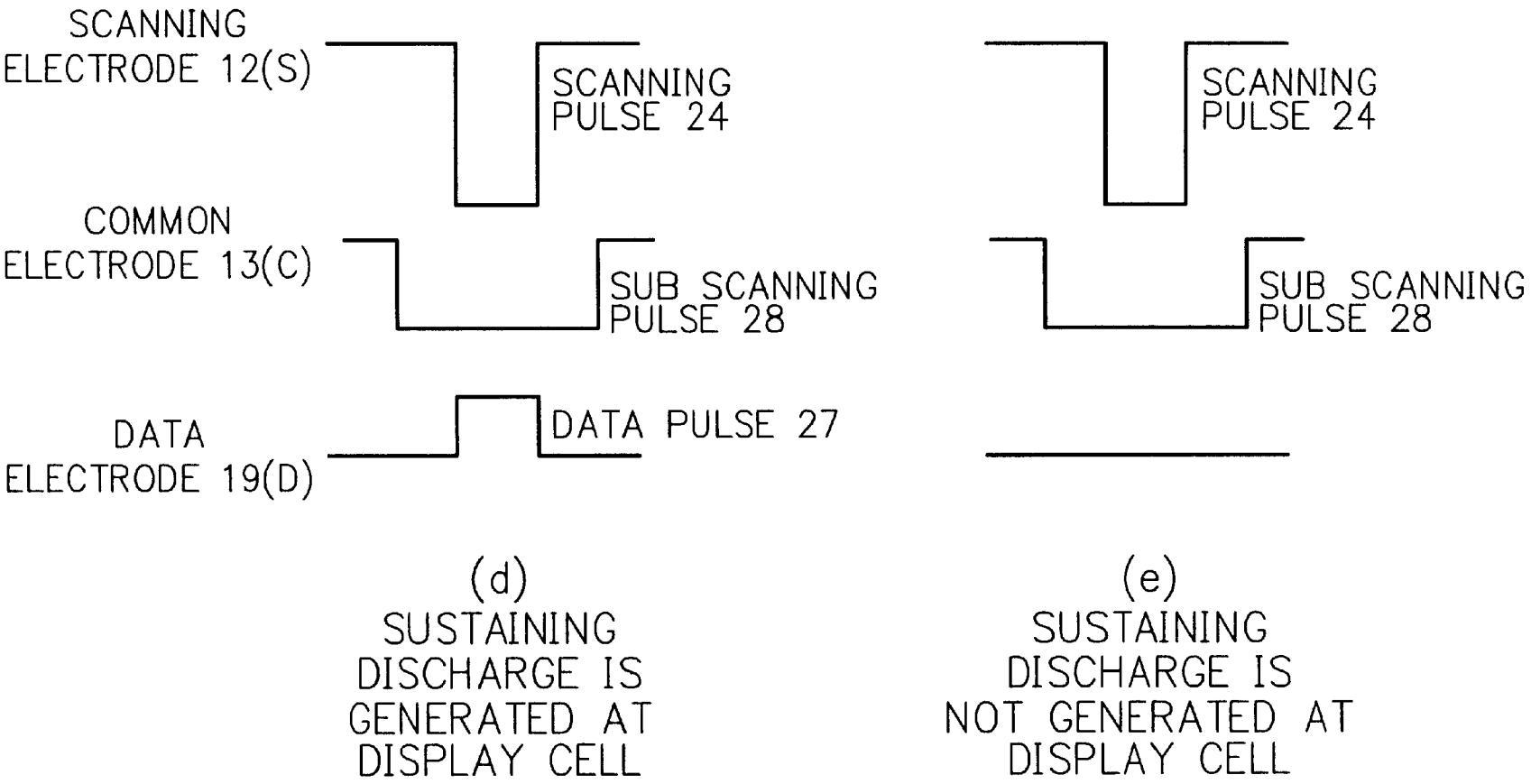
FIG. 9 is a timing chart showing driving voltage waveforms at the AC-PDP at a first embodiment of the present invention.

Referring to the drawing, a first embodiment of the present invention is explained. FIG. 9 is a timing chart showing driving voltage waveforms during the scanning period at the AC-PDP at the first embodiment of the present invention. In FIG. 9(*d*), the sustaining discharge is generated at a display cell, and in FIG. 9(*e*), the sustaining discharge is not generated at the display cell, during the sustaining period.

First, a case shown in FIG. 9(*e*) is explained. In this case, for example, a scanning pulse 24 being negative polarity of 215V is applied to the scanning electrode 12, and a sub scanning pulse 28 being negative polarity of 55V is applied to the common electrode 13 and a data pulse is not applied to the data electrode 19. In this case, the potential difference between surface electrodes (12 and 13) becomes 160V and the potential difference between facing electrodes (12 and 19) becomes 215V, and the writing discharge is generated but the sustaining discharge is not generated as shown in FIG. 7.

Second, a case shown in FIG. 9(*d*) is explained. In this case, for example, a scanning pulse 24 being negative polarity of 215V is applied to the scanning electrode 12, a sub scanning pulse 28 being negative polarity of 55V is applied to the common electrode 13, and a data pulse 27 being positive polarity of 35V is applied to the data electrode 19. In this case, the potential difference between surface electrodes (12 and 13) becomes 160V and the potential difference between facing electrodes (12 and 19) becomes 250V, and the writing discharge is generated and also the sustaining discharge is generated. As shown in FIG. 7, at the potential difference between surface electrodes of 160V, the range of the potential difference between facing electrodes, in which the writing discharge is not shifted to the sustaining discharge, is wide enough. Therefore, even the number of display cells, whose characteristics are slightly different, is large, all of the display cells can be controlled together under the same condition.

As mentioned above, by using the sub scanning pulse 28 being negative polarity, at all of the display cells, of which a large size PDP is composed, the writing discharge is generated even when the writing discharge is not shifted to the sustaining discharge. With this, an effect, which the writing discharge at the adjacent display cell is made to be high speed, can be given. That is, a high speed displaying can be executed. Further, the crest value of the data pulse 27 is about 35V, and this value is reduced largely, compared with the crest value of 70V at the conventional driving method, that is, this crest value of the data pulse 27 is almost half of that at the conventional technology. This is another effect at the present invention. This reduction of the voltage of the data pulse 27 contributes to the reduction of the power consumption and also the reduction of the manufacturing cost.

Figure 10:
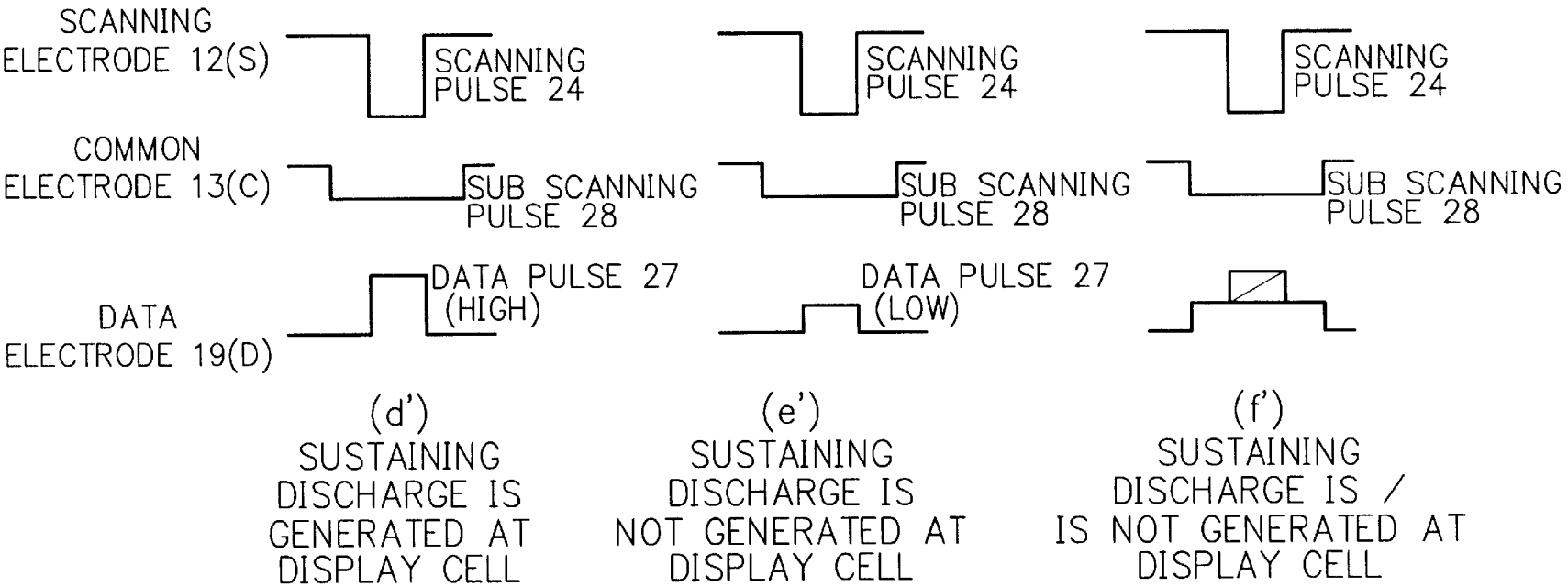
FIG. 10 is a timing chart showing driving voltage waveforms at the AC-PDP at a second embodiment of the present invention.

Next, referring to the drawing, a second embodiment of the present invention is explained. FIG. 10 is a timing chart showing driving voltage waveforms during the scanning period at the AC-PDP at the second embodiment of the present invention. In FIG. 10(*d'*), the sustaining discharge is generated at a display cell, and in FIG. 10(*e'*), the sustaining discharge is not generated at the display cell during the sustaining period. And in FIG. 10(*f'*), the sustaining discharge is generated or not generated at the display cell during the sustaining period.

First, a case shown in FIG. 10(*e'*) is explained. In this case, for example, a scanning pulse 24 being negative polarity of 180V is applied to the scanning electrode 12, a sub scanning pulse 28 being negative polarity of 20V is applied to the common electrode 13, and a data pulse 27 being positive polarity of 35V is applied to the data electrode 19. In this case, the potential difference between surface electrodes (12 and 13) becomes 160V and the potential difference between facing electrodes (12 and 19) becomes 215V, therefore, the writing discharge is generated but the sustaining discharge is not generated. The potential difference between surface electrodes and the potential difference between facing electrodes of this case become the same as those at the case shown in FIG. 9(*e*). Therefore, the operation becomes the same as the case shown in FIG. 9(*e*).

Second, a case shown in FIG. 10(*d'*) is explained. In this case, for example, a scanning pulse 24 being negative polarity of 180V is applied to the scanning electrode 12, a sub scanning pulse 28 being negative polarity of 20V is applied to the common electrode 13, and a data pulse 27 being positive polarity of 70V is applied to the data electrode 19. In this case, the potential difference between surface electrodes (12 and 13) becomes 160V and the potential difference between facing electrodes (12 and 19) becomes 250V, therefore, the writing discharge is generated and also the sustaining discharge is generated. The potential difference between surface electrodes and the potential difference between facing electrodes of this case become the same that those at the case shown in FIG. 9(*d*). Therefore, the operation becomes the same as the case shown in FIG. 9(*d*).

At the second embodiment of the present invention, it is necessary that the data pulse 27 whose crest value is low is applied to the display cell which does not generate the sustaining discharge, and the data pulse 27 whose crest value is high is applied to the display cell which generates the sustaining discharge. However, the crest value of the scanning pulse 24 is enough to be a small value (180V) that is almost the same value at the conventional technology. Therefore, the display cells can be worked without applying a special change (strengthening against voltage) to the scanning driver that outputs the scanning pulse 24, at the present invention.

At the second embodiment of the present invention, the data pulse 27 whose crest value is low, applying to the display cell that does not generate the sustaining discharge, is not required to stop at the time or at almost the same time when the scanning pulse 24 ends. As shown in FIG. 10(*f*'), first, a voltage corresponding to the data pulse 27, whose crest value is low, is applied to the data electrode 19 as a bias voltage state in the almost whole scanning period, and next, the difference value from the data pulse whose crest value is high is added to the bias voltage at the data electrode 19 corresponding to the display cell that generates the sustaining discharge. With this, the same effect at the present invention can be obtained. By this operation, the modulation value (the crest value of the adding pulse), which affects the power consumption, is decreased, and the power consumption can be decreased.

Figure 11:
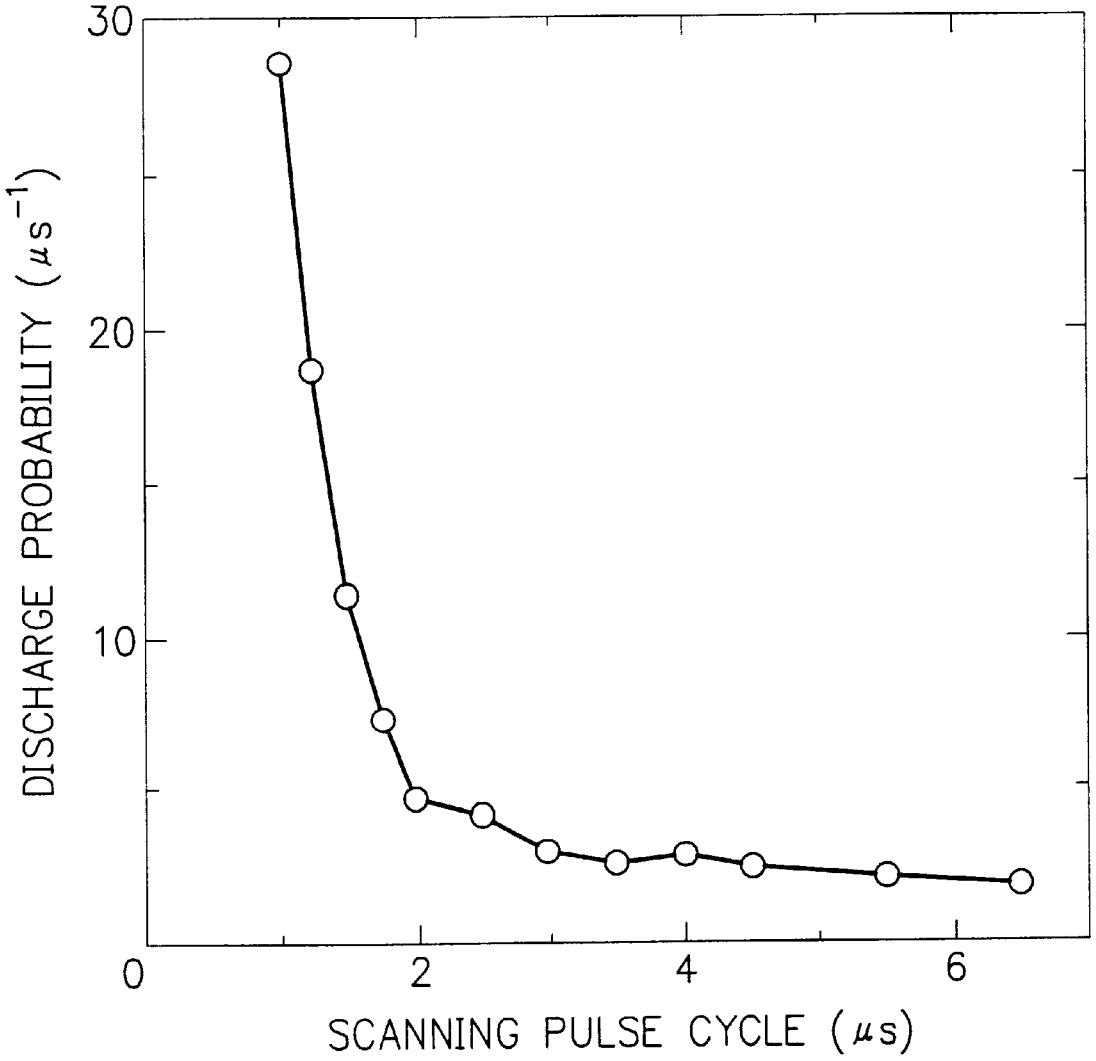
FIG. 11 is a graph showing the relation between a scanning pulse cycle and discharge probability in the AC-PDP at a third embodiment of the present invention.

Next, referring to the drawing, a third embodiment of the present invention is explained. FIG. 11 is a graph showing the relation between a scanning pulse cycle and discharge probability in the AC-PDP at the third embodiment of the present invention. In FIG. 11, the scanning pulse cycle, at the time when the sustaining discharge is generated at an only one designated display cell, is shown, and the discharge probability at the designated display cell is shown.

In case that the timing when a scanning pulse is applied to the (i)th scanning electrode is defined as $t_i$ and the timing when the scanning pulse is applied to the (i+1)th scanning electrode is defined as $t_{i+1}$, the scanning pulse cycle is the time interval $(t_{i+1}-t_i)$. At the only one designated display cell, the writing discharge is made to be high speed, by receiving electric charge particles generated by the writing discharge not shifting to the sustaining discharge at the display cell adjacent to right above the only one designated cell. That is, the discharge probability is increased at the only one designated display cell. The effect increasing the discharge probability depends on the time and space interval from the writing discharge at the display cell adjacent to right above the only one designated display cell.

In FIG. 11, the dependence of the discharge probability for the time interval (scanning pulse cycle) is shown. In this case, the space interval (pitch between scanning electrodes) is fixed to be 1.05 mm. As shown in FIG. 11, the shorter the scanning pulse cycle is, the larger the discharge probability becomes. At the third embodiment of the present invention, the scanning pulse cycle was made to be less than $2\mu$ seconds, and the discharge probability was made to be large.

The third embodiment of the present invention can be applied to the first and second embodiments of the present invention. In this case, the scanning pulse cycle is made to be less than $2\mu$ seconds, and the driving method, in which the writing discharge is also generated at a display cell that does not shift to the sustaining discharge, is applied. With this, displaying at the display cells becomes high speed, and the writing discharge is surely generated at the short scanning pulse width.

As mentioned above, at the first, second, and third embodiments of the present invention, the writing discharges at all of the display cells are made to be high speed, by receiving the electric charge particles supplying from a display cell adjacent right above to the display cells. With this, the conventional priming discharge and priming discharge erasing can be omitted, and the sureness at the writing discharge is not decreased.

By the explanation mentioned above, the priming discharge and priming discharge erasing can be omitted form all or a part of the sub fields. And at the present invention, the time requiring at the priming discharge and priming discharge erasing at the conventional technology can be utilized for increasing the number of sustaining pulses. That is, by omitting the time requiring at the priming discharge and priming discharge erasing, this omitted time can be used for the sustaining discharge, therefore the sustaining discharge time can be increased, as a result, the light emitting luminance can be increased. And also, the time requiring at the priming discharge and priming discharge erasing at the conventional technology can be utilized for increasing the scanning period, and the number of scanning electrodes and the number of the common electrodes can be increased. Consequently, the number of display cells can be increased.

At the embodiments of the present invention, driving the display cells was made to be high speed by receiving electric charge particles supplied from the adjacent display cell belonging to the right above scanning electrode 12, and the priming discharge and the priming discharge erasing were omitted. However, at the display cells belonging to the first scanning electrode 12, there are no electric charge particles supplying from the display cells belonging to the previous scanning electrode 12.

In order to solve this, the pulse width of the first scanning pulse 24 and the pulse width of a data pulse 27 synchronizing with the first scanning pulse 24 are widened. With this, the writing discharges of the display cells belonging to the first scanning electrode 12 are surely generated in the scanning period. Or instead of this, the crest value of the scanning pulse 24, being applied at the first time, in the scanning period, is set to be higher than that of scanning pulses 24 following this scanning pulse 24, with this, the writing discharge by the first scanning pulse 24 is made to be sure.

Further, there is another solution for this. In this solution, the priming discharge and the priming discharge erasing are applied only to the display cells for the first scanning pulse 24, and the priming discharge and the priming discharge erasing are not applied to the display cells for the scanning pulses 24 following the first scanning pulse 24. With this, the writing discharges are surely generated at the display cells belonging to the first scanning electrode 12 by the effects of the priming discharge and the priming discharge erasing, as the same as at the conventional driving method. And the writing discharges are surely generated at the display cells belonging to the scanning electrodes 12 following the first scanning electrode 12 by receiving the electric charge particles supplying from the adjacent right above display cells. Further, by shielding light at a part of the front substrate 10, where the display cells belonging to the first scanning electrode 12 exist, an image is actually displayed by using the scanning electrodes 12 except the first scanning electrode 12. With this, the contrast of the image can be increased.

As mentioned above, at the PDP driving method of the present invention, a sub scanning pulse is applied to the common electrodes in the scanning period, and a writing discharge having first intensity is generated at display cells, which do not generate a sustaining discharge later in the sustaining period, and a writing discharge having second intensity is generated at display cells, which generate the sustaining discharge later in the sustaining period, by further applying a data pulse. With this, a part of a priming discharge time and a part of a priming discharge erasing time can be omitted, and this omitted time can be allocated to the sustaining period or the scanning period. Therefore, the number of scanning electrodes and the number of common electrodes can be increased, and the number of display cells can be increased. Consequently, the high resolution can be realized.

Moreover, at the PDP driving method of the present invention, a writing discharge having first intensity is generated at display cells, which do not generate a sustaining discharge later in the sustaining period, by applying a data pulse having a first crest value. And a writing discharge having second intensity is generated at display cells, which generate the sustaining discharge later in the sustaining period, by applying a data pulse having a second crest value. Further, the data pulse having the first crest value can be applied to all of the data electrodes in a bias state during almost all the scanning period, and a modulation voltage value is added to the data electrodes corresponding to the display cells that generate the sustaining discharge later so that the voltage value applying to the data electrodes becomes the second crest value. With this, a special change is not required at the panel structure, and only a slight change is required at the driving circuit, therefore, the current manufacturing process can be used at the present invention.

Furthermore, at the PDP driving method of the present invention, the scanning pulse cycle can be made to be less than $2\mu$ seconds, with this, high speed displaying can be realized.

And, at the PDP driving method of the present invention, the pulse width of the scanning pulse applying to the first scanning electrode is wider than that applying to scanning electrodes following the first scanning electrode, and also the pulse width of the first data pulse synchronizing with the scanning pulse applying to the first scanning electrode, is wider than that of following data pulses, in the scanning period. And the crest value of the first scanning pulse is larger than that of scanning pulses following the first scanning pulse. And a priming discharge and a priming discharge erasing are executed only for the display cells to which the first scanning pulse is applied, and the priming discharge and the priming discharge erasing are not executed for the display cells which follows the display cells to which the first scanning pulse is applied. Therefore, the operation is simplified and the power consumption is reduced.

As mentioned above, according to the AC-PDP of the present invention, a special change for the current panel structure is not required and a slight change is applied to the driving circuit to apply a sub scanning pulse. With these, the yielding ratio at the manufacturing becomes stable, the writing discharge can be executed stably by even using scanning pulses whose width is small, and the light emitting luminance is increased by extending the sustaining period in one sub field, and an image being high resolution can be obtained.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A plasma display panel (PDP) driving method, wherein:

said PDP comprises:

a first substrate having a plane shape and a second substrate having a plane shape which faces said first substrate;

plural first row electrodes and plural second row electrodes arrayed in a row direction on said first substrate;

plural column electrodes arrayed in a column direction on said second substrate; and plural display cells disposed at points where said plural column electrodes cross said plural first and second row electrodes, wherein said PDP driving method comprises;

applying a scanning pulse to each of said plural first row electrodes by shifting the applying timing of said scanning pulse by a designated interval in a scanning period;

applying a first data pulse to at least one of said plural column electrodes by synchronizing said first data pulse with said scanning pulse in said scanning period;

applying a sustaining pulse to said plural first and second row electrodes in a sustaining period to generate a sustaining discharge only at said display cell which corresponds to said first data pulse; and applying a sub scanning pulse to the plural second row electrodes in the scanning period which reduces the potential difference between the plural first row electrodes and the plural second row electrodes, wherein all of said display cells generate a writing discharge.

2. The PDP driving method of claim 1, wherein a scanning pulse cycle, which is the time interval (ti+1-ti) in case that the timing when a scanning pulse is applied to the (i)th first row electrode is defined as ti and the timing when said scanning pulse is applied to the (i+1)th first row electrode is defined as ti+1, is less than $2\mu$ seconds.

3. The PDP driving method of claim 1, wherein the pulse width of said scanning pulse applied to the first electrode in said plural first row electrodes is wider than that applied to electrodes following said first electrode, and also the pulse width of said data pulse synchronizing with said scanning pulse applied to the first electrode in the plural first row electrodes, is wider than the others, in said scanning period.

4. The PDP driving method of claim 1, wherein the crest value of said scanning pulse applying to the first electrode of said plural first row electrodes is larger than that applying to electrodes following said first electrode, in said scanning period.

5. The PDP driving method of claim 1, wherein a priming discharge pulse and a priming discharge erasing pulse are only applied to said display cells at the first electrode in said plural first row electrodes to which said scanning pulse is applied.

6. The PDP driving method of claim 1, wherein said sub scanning pulse comprises a negative polarity.

7. The PDP driving method of claim 1, further comprising applying a positive polarity bias voltage to said column electrodes in almost all of said scanning period.

8. The method of claim 1, wherein said scanning pulse generates a writing discharge having a first intensity in a display cell which does not generate a sustaining discharge, and wherein said scanning pulse and said first data pulse generate a writing discharge having a second intensity in a display cell which does generate a sustaining discharge.

9. The PDP driving method of claim 8, wherein:

when said scanning pulse is applied to each of said plural first row electrodes, said writing discharge having said first intensity is generated in said display cells, which do not generate said sustaining discharge later, by applying a second data pulse, said second data pulse has a first crest value, said writing discharge having said second intensity is generated in said display cells, which generate said sustaining discharge later, and said first data pulse has a second crest value.

10. The PDP driving method of claim 9, wherein said first crest value is lower than said second crest value.

11. The PDP driving method of claim 10, wherein:

said second data pulse having said first crest value is applied in a bias state during almost all of said scanning period, and a modulation voltage value is added to said column electrodes corresponding to display cells that generate said sustaining discharge later so that said voltage value applying to said column electrodes becomes said first data pulse having said second crest value.

12. The PDP driving method of claim 8, wherein said writing discharge having said first intensity is weaker than said writing discharge having said second intensity.

13. A Plasma Display Panel (PDP), comprising:

a first substrate having a plane shape and a second substrate having a plane shape which faces said first substrate;

plural first row electrodes and plural second row electrodes arrayed in a row direction on said first substrate;

plural column electrodes arrayed in a column direction on said second substrate; and plural display cells disposed at points where said plural column electrodes cross said plural first and second row electrodes, wherein:

a scanning pulse is applied to each of said plural first row electrodes by shifting the applying timing of said scanning pulse by a designated interval in a scanning period;

a first data pulse is applied to at least one of of said plural column electrodes by synchronizing said first data pulse with said scanning pulse in said scanning period;

a sustaining pulse is applied to said plural first and second row electrodes in a sustaining period to generate a sustaining discharge only at said display cells which correspond to said first data pulse; and a sub scanning pulse is applied to said plural second row electrodes in said scanning period which reduces the potential difference between the plural first row electrodes and the plural second row electrodes, wherein all of said display cells generate a writing discharge.

14. The PDP of claim 13, wherein the pulse width of said scanning pulse applied to the first electrode in said plural first row electrodes is wider than that applied to electrodes following said first electrode, and also the pulse width of said data pulse synchronizing with said scanning pulse applied to the first electrode in the plural first row electrodes, is wider than the others, in said scanning period.

15. The PDP of claim 13, wherein a priming discharge pulse and a priming discharge erasing pulse are only applied to said display cells at the first electrode in said plural first row electrodes to which said scanning pulse is applied.

16. The PDP of claim 13, wherein said scanning pulse generates a writing discharge having a first intensity in a display cell which does not generate a sustaining discharge, and wherein said scanning pulse and said first data pulse generate a writing discharge having a second intensity in a display cell which does generate a sustaining discharge.

17. The PDP of claim 16, wherein:

when said scanning pulse is applied to each of said plural first row electrodes, said writing discharge having said first intensity is generated in said display cells, which do not generate said sustaining discharge later, by applying a second data pulse having a first crest value, said writing discharge having said second intensity is generated in said display cells, which generate said sustaining discharge later, and said first data pulse has a second crest value.

18. The PDP of claim 17, wherein said first crest value is lower than said second crest value.

19. A method for driving a plasma display panel comprising:

applying a scanning pulse to each of a plurality of scanning electrodes;

applying a data pulse to at least one of a plurality of column electrodes;

applying a sub scanning pulse to each of a plurality of common electrodes which reduces the potential difference between the plurality of scanning electrodes and the plurality of common electrodes; and applying a sustaining pulse to each of said plurality of scanning electrodes and each of said plurality of common electrodes, wherein all of said display cells generate a writing discharge and only said at least one of the plurality of column electrodes to which said data pulse is applied generates a sustaining discharge.

20. A plasma display panel comprising:

a plurality of scanning electrodes and a plurality of common electrodes on a first substrate;

a plurality of column electrodes on a second substrate which faces said first substrate; and a controller which:

applies a scanning pulse to each of a plurality of scanning electrodes, applies a data pulse to at least one of a plurality of column electrodes;

applies a sub scanning pulse to each of a plurality of common electrodes which reduces the potential difference between the plurality of scanning electrodes and the plurality of common electrodes; and applies a sustaining pulse to each of said plurality of scanning electrodes and each of said plurality of common electrodes, wherein all of said display cells generate a writing discharge and only said at least one of the plurality of column electrodes to which said data pulse is applied generates a sustaining discharge.

21. A method of driving a plasma display panel, comprising;

applying a scanning pulse to each of a plurality of first row electrodes in a scanning period;

writing display information in selected display cells by applying a data pulse to each of column electrodes that correspond to said selected display cells in synchronism with said scanning pulse in said scanning period; and sustaining a discharge at said selected display cells by applying sustaining pulses between said first row electrodes and second row electrodes in a sustaining period, wherein said writing display information comprises applying a potential difference between the column electrode and the first row electrode to each of non-selected display cells that generates a discharge in said scanning period but does not generate a sustaining discharge in said sustaining period while applying a potential difference between the column electrode and the first row electrode to each of said selected display cells that generates a discharge in said scanning period and also generates a sustaining discharge in said sustaining period, and wherein said writing display information further comprises applying a sub scanning pulse to said second row electrodes in said scanning period that decreases a potential difference between the first row electrode and the second row electrode at each of said display cells.

22. The method of claim 21, wherein the scanning pulse comprises a first potential of a first polarity with respect to a reference potential, wherein the data pulse comprises a second polarity opposite to said first polarity with respect to said reference potential, and wherein the sub scanning pulse comprises a second potential of said first polarity.

23. The method of claim 22, wherein the scanning pulse and the sub scanning pulse comprise a negative potential with respect to said reference potential and the data pulse comprise a positive potential with respect to said reference potential.

24. The method of claim 22, wherein the data pulse comprises a first potential that is applied to each of said column electrodes as a bias voltage during at least a majority of said scanning period and a second potential which is larger than said first potential that is applied only to the selected display cells in said scanning period.

25. The method of claim 22, wherein the potential of the data pulse applied to the selected display cells is larger than that of the data pulse applied to the non-selected display cells.

26. The method of with claim 21, wherein the scanning pulse and the sub scanning pulse comprise a negative potential with respect to the ground potential.

27. The method of claim 21, wherein the data pulse comprises a positive potential with respect to the ground potential that is applied to each of said column electrodes as a bias voltage during at least majority of said scanning period.

* * * * *